US005288956A

United States Patent [19]

Kadokura et al.

[11] Patent Number: 5,288,956

[45] Date of Patent: Feb. 22, 1994

[54] SELF RUNNING TYPE ELEVATOR SYSTEM USING LINEAR MOTORS

[75] Inventors: Toshio Kadokura; Ryoichi Kurosawa, both of Tokyo, Japan

[73] Assignee: Kabushiki Kaisha Toshiba, Tokyo, Japan

[21] Appl. No.: 833,797

[22] Filed: Feb. 12, 1992

[30] Foreign Application Priority Data

Feb. 14, 1991 [JP] Japan ..... 3-020705

[51] Int. Cl.[5] ..... B66B 1/34

[52] U.S. Cl. ..... 187/112; 187/16; 187/116

[58] Field of Search ..... 187/112, 115, 116, 117, 187/122, 16

[56] References Cited

U.S. PATENT DOCUMENTS

| | | | |
|---|---|---|---|
| 3,582,756 | 6/1971 | McMurray | 363/1 |
| 3,896,736 | 7/1975 | Hamy | 104/88 |
| 4,480,299 | 10/1984 | Moto et al. | 363/41 |
| 4,739,464 | 4/1988 | Nishihiro et al. | 363/37 |
| 4,851,982 | 7/1989 | Tanahashi | 363/37 |

FOREIGN PATENT DOCUMENTS

| | | | |
|---|---|---|---|
| 0471464 | 2/1992 | European Pat. Off. | 187/112 |
| 3331950 | 4/1985 | Fed. Rep. of Germany . | |
| 3722295 | 1/1989 | Fed. Rep. of Germany . | |
| 3900511 | 7/1990 | Fed. Rep. of Germany . | |
| 3-12871 | 2/1991 | Japan . | |
| 4-101975 | 4/1992 | Japan | 187/116 |
| 4-354771 | 12/1992 | Japan | 187/116 |

*Primary Examiner*—Emanuel T. Voeltz
*Assistant Examiner*—Thomas M. Dougherty
*Attorney, Agent, or Firm*—Oblon, Spivak, McClelland, Maier & Neustadt

[57] ABSTRACT

A self running type elevator system using linear motors in which a control of power supply to a plurality of elevator cars can be achieved without increasing the size of the system enormously. The system includes at least one travelling corridors, each of which is equipped with a primary coil of a linear motor; a plurality of elevator cars placed inside the travelling corridors, each of which is equipped with a secondary conductor of the linear motor; and a plurality of control device means, provided in correspondence to the elevator cars, for controlling a supply of a driving power to the primary coil at a position of the elevator car such that the elevator car is driven by a driving force produced between the primary coil and the secondary conductor of the linear motor by the driving power.

20 Claims, 7 Drawing Sheets

SELF RUNNING TYPE ELEVATOR SYSTEM USING LINEAR MOTORS

BACKGROUND OF THE INVENTION

1. Field of the Invention

The present invention relates to an elevator system using linear motors as driving devices in which self running type elevator cars can move in both vertical and horizontal directions and a plurality of such self running type elevator cars can be operated simultaneously within a single travelling corridor.

2. Description of the Background Art

Apart from a hydraulic type elevator system in which an elevator car is moved up and down by using a hydraulic plunger and a hoisting drum type elevator system used for a relatively small capacity purpose, a type of an elevator system most widely used conventionally is that in which an elevator car and a balance weight are suspended on opposite ends of a rope in which a single elevator car is operated to move up and down through a single travelling corridor, as shown in FIG. 1.

In this type of a conventional elevator system shown in FIG. 1, an elevator car 1 and a balance weight 2 are provided between guide rails 3 and guide rails 4, respectively, located within a travelling corridor, and they are suspended on opposite ends of a rope 8 through a sheave 6 and a bending sheave 7 of a hoisting machine 5 located in a machine chamber provided above the travelling corridor. In recent years, a three-phase induction motor is used for a driving device and an inverter device using a micro-processor is used for a control device in such a conventional elevator system.

This conventional elevator system shown in FIG. 1 has an advantage that the driving device and the control device of small size can be used so long as it is possible to provide a driving power for moving the elevator car 1 which is equivalent to the weight difference between the balance weight 2 and the elevator car 1 apart from the mechanical running loss, and moreover it is quite reliable because the techniques related to the performance and the safety of such a conventional elevator system have already been very well established through the extensive practical use in the past.

However, in recent years, there has been a number of propositions for a new type of elevator system in view of a possible future use in a super multistory building.

One type of the recently proposed new elevator systems is that in which no rope is used and a self running elevator car is used, where the elevator car can move not only in up and down directions but also in horizontal directions.

The concept of such a self running type elevator system is highly respected as a revolutionary technique which can make a breakthrough in a conventional preconception of one elevator car per one travelling corridor in an elevator system.

An exemplary overall configuration of such a self running type elevator system is shown in FIG. 2, in which a plurality of elevator cars 9 are provided in a plurality of vertical and horizontal travelling corridors, where each of a plurality of elevator cars 9 is equipped with a secondary conductor 10 of a linear motor, and each travelling corridor is equipped with a primary coil 31 of a linear motor, such that the driving force is obtained by the magnetic forces produced between the primary coil 31 and the secondary conductor 10 of the linear motor. Each elevator car 9 is further equipped with a brake 12 for stopping the motion of the elevator car 9, a shock absorber 13 for absorbing the shock due to the collision of the neighboring elevator cars 9, and a superconducting magnet 14 provided inside or below the shock absorber 13 for coupling the neighboring elevator cars 9.

In this elevator system of FIG. 2, the travelling corridor at the top floor is also equipped with a suspending machine 15 for catching and suspending the elevator car 9 reaching to the top floor, and a movable plate member 16 for enabling the horizontal running of the elevator car 9 on the top floor level, while the travelling corridor at the bottom floor is also equipped with a hydraulic jack 17 having a plate member for supporting the elevator car 9 reaching to the bottom floor and allowing the horizontal running of the elevator car 9 on the bottom floor level.

As for a control system for controlling power supply to each elevator car in such a self running type elevator system using linear motors, a system shown in FIG. 3 has been conventionally proposed.

In this control system shown in FIG. 3, the primary coil 31 provided on each travelling corridors A to Z is divided into a plurality of sections 1 to X, and a control device 32 for controlling power supply is provided for each j-th section of each i-th travelling corridor, where each control device 32 is equipped with a section selection switch 33 for each one of the elevator cars a to y. In a case the k-th elevator car is to run through the j-th section of the i-th travelling corridor, the ijk-th section selection switch 33 is activated by the ij-th control device 32 such that the current is supplied to the jk-th primary coil 31 in order to drive the k-th elevator car through the j-th section of the i-th travelling corridor.

However, in such a conventionally proposed control system for the self running type elevator system using linear motors, the control device 32 for controlling the power supply must be provided for each section of each travelling corridor, so that as a number of the travelling corridors increases and a length of each travelling corridor becomes longer, an enormous number of control devices 32 would become necessary, and when the current supply lines are connected to each of these enormous number of control devices 32, an enormous number of main circuit current supply lines are also required, such that the size of the system inevitably increases enormously.

SUMMARY OF THE INVENTION

It is therefore an object of the present invention to provide a self running type elevator system using linear motors in which a control of power supply to a plurality of elevator cars can be achieved without increasing the size of the system enormously.

According to one aspect of the present invention there is provided a self running type elevator system, comprising: at least one travelling corridors, each of which is equipped with a primary coil of a linear motor; a plurality of elevator cars placed inside the travelling corridors, each of which is equipped with a secondary conductor of the linear motor; and a plurality of control device means, provided in correspondence to the elevator cars, for controlling a supply of a driving power to the primary coil at a position of the elevator car such that the elevator car is driven by a driving force produced between the primary coil and the secondary conductor of the linear motor by the driving power.

According to another aspect of the present invention there is provided a method of controlling a self running type elevator system comprising at least one travelling corridors, each of which is equipped with a primary coil of linear motor, and a plurality of elevator cars placed inside the travelling corridors, each of which is equipped with a secondary conductor of the linear motor, the method comprising the steps of: providing a plurality of control device means in correspondence to the elevator cars, for controlling power supply to the primary coil; and controlling the power supply to the primary coil by the control device means such that a driving power is supplied to the primary coil at a position of the elevator car in order to drive the elevator car by a driving force produced between the primary coil and the secondary conductor of the linear motor by the power supply.

Other features and advantages of the present invention will become apparent from the following description taken in conjunction with the accompanying drawings.

DETAILED DESCRIPTION OF THE PREFERRED EMBODIMENTS

Now, one embodiment of a self running type elevator system using linear motors according to the present invention will be described.

Figure 1:
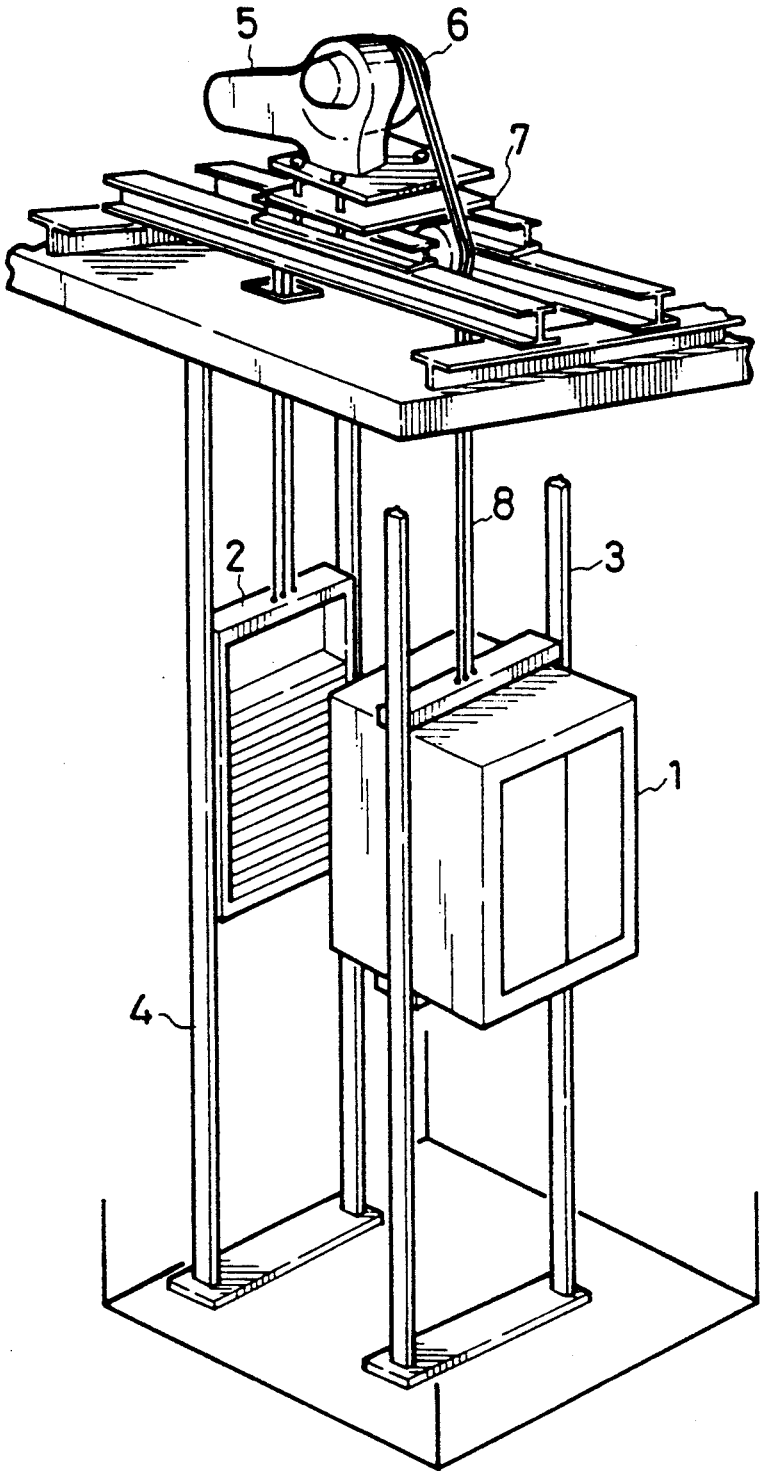
FIG. 1 PRIOR ART
FIG. 1 is a perspective view of an exemplary configuration for one type of a conventional elevator system.
Figure 2:
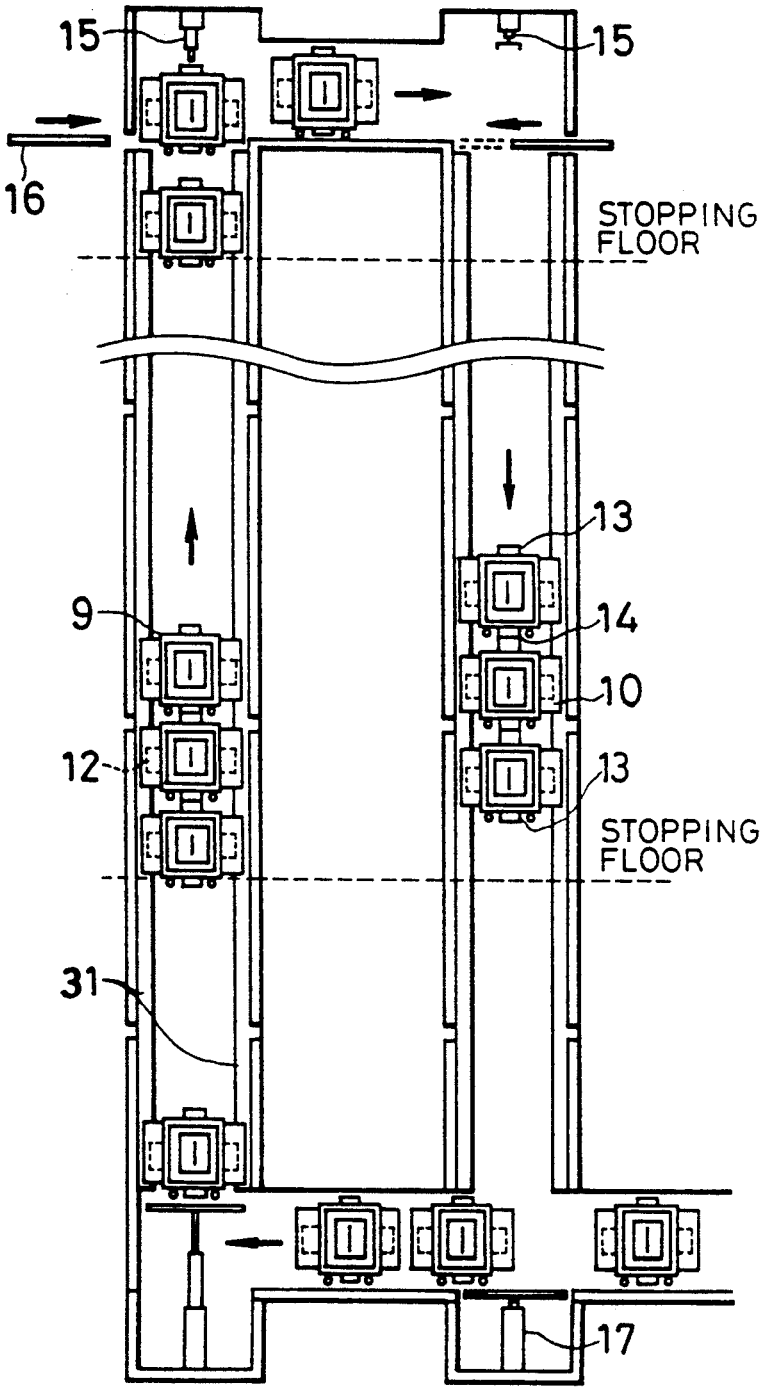
FIG. 2 PRIOR ART
FIG. 2 is a diagram of an exemplary configuration for a conventionally proposed self running type elevator system using linear motors.
Figure 3:
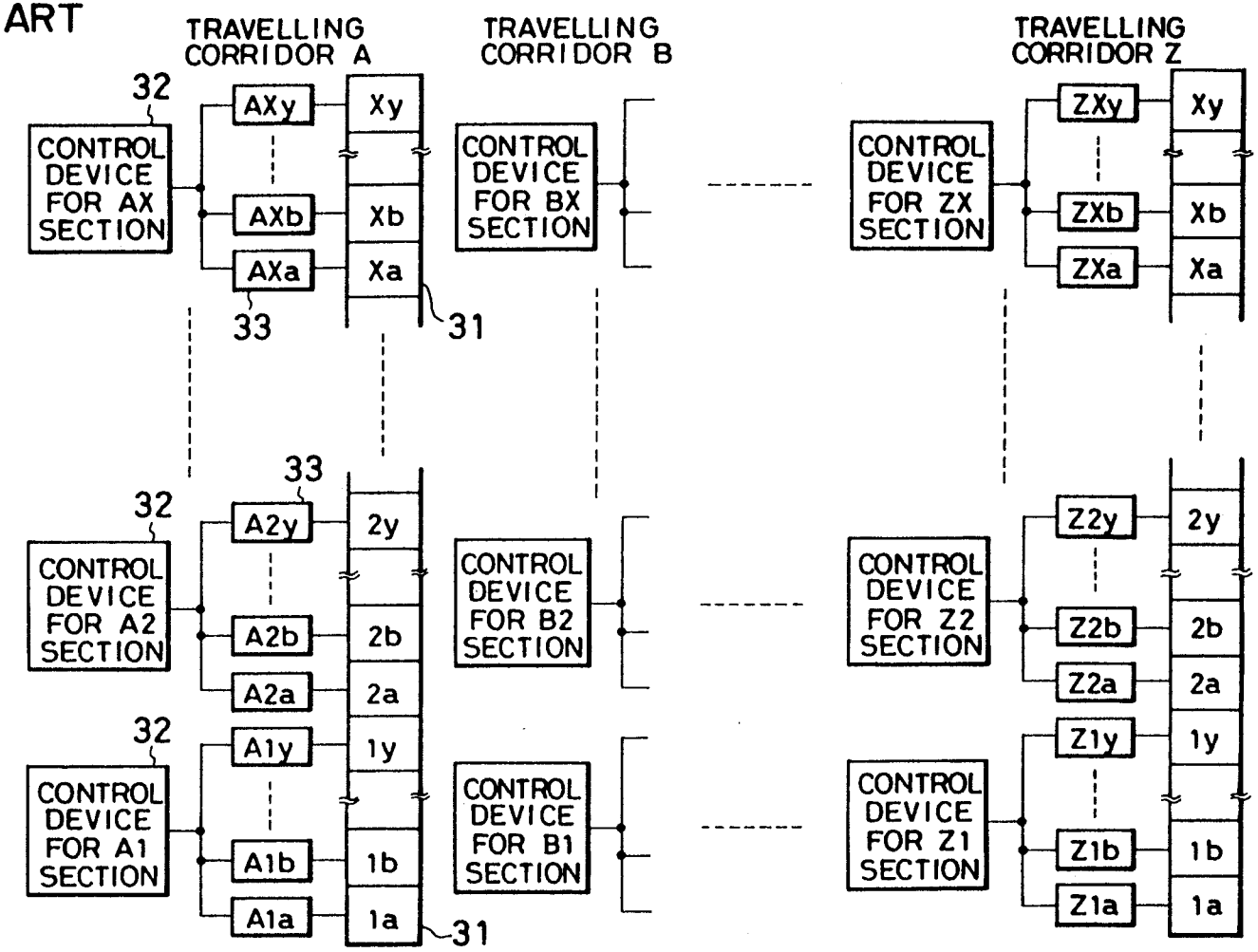
FIG. 3 PRIOR ART
FIG. 3 is a diagram of an exemplary configuration for a conventionally proposed control system to be used in the self running type elevator system of FIG. 2.

In this embodiment, a self running type elevator system has an overall configuration similar to that shown in FIG. 2, in which a plurality of elevator cars 9 (1st to X-th) are provided in a plurality of vertical and horizontal travelling corridors (A to Z), where each of a plurality of elevator cars 9 is equipped with a secondary conductor 10 of a linear motor, and each travelling corridor is equipped with a primary coil 31 of a linear motor, such that the driving force is obtained by the magnetic forces produced between the primary coil 31 and the secondary conductor 10 of the linear motor. Each elevator car 9 is further equipped with a brake 12 for stopping the motion of the elevator car 9, a shock absorber 13 for absorbing the shock due to the collision of the neighboring elevator cars 9, and a superconducting magnet 14 provided inside or below the shock absorber 13 for coupling the neighboring elevator cars 9. The travelling corridor at the top floor is also equipped with a suspending machine 15 for catching and suspending the elevator car 9 reaching to the top floor, and a movable plate member 16 for enabling the horizontal running of the elevator car 9 on the top floor level, while the travelling corridor at the bottom floor is also equipped with a hydraulic jack 17 having a plate member for supporting the elevator car 9 reaching to the bottom floor and allowing the horizontal running of the elevator car 9 on the bottom floor level.

Figure 4:
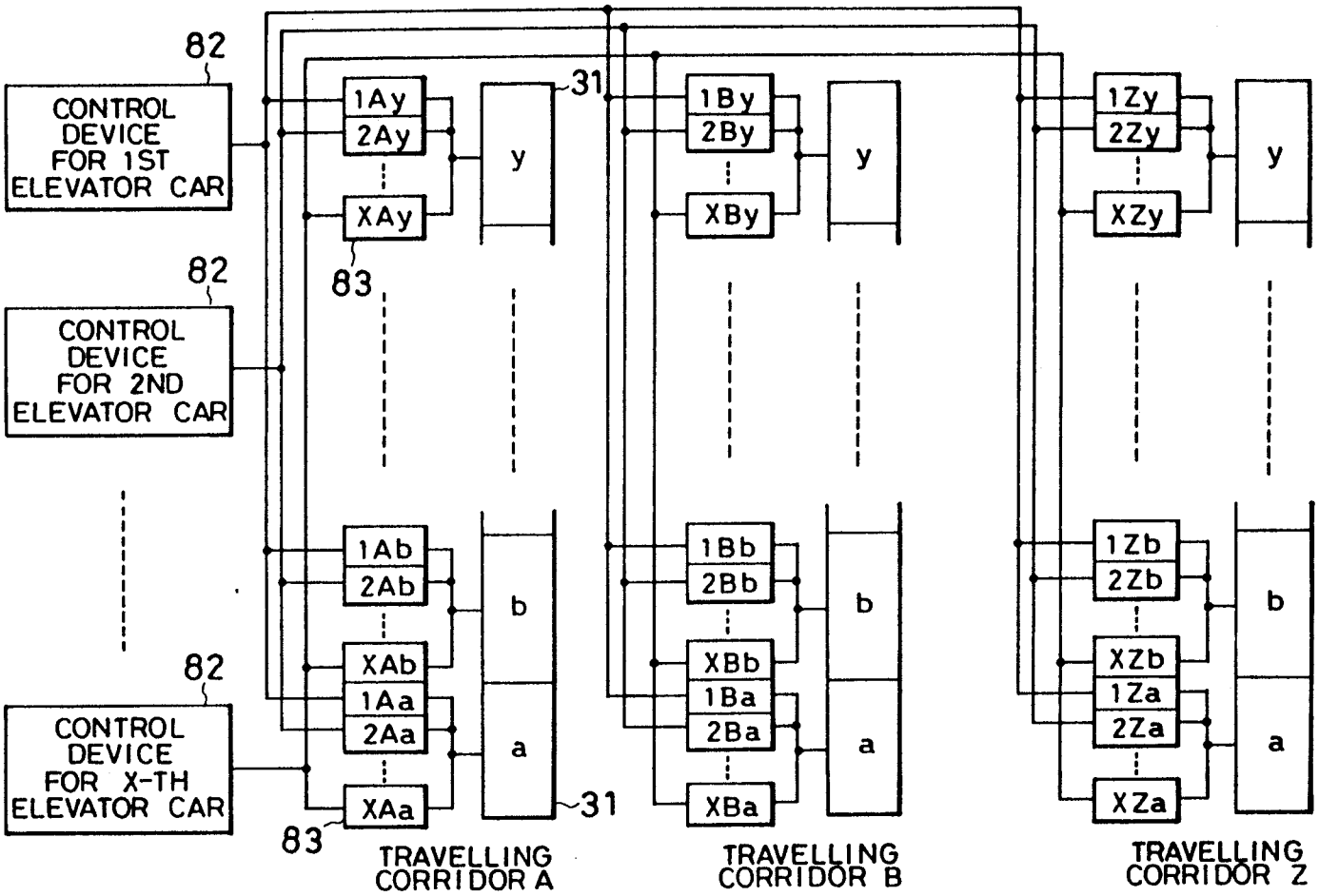
FIG. 4 is a diagram of a configuration for a control system to be used in one embodiment of a self running type elevator system using linear motors according to the present invention.

In addition, this embodiment of a self running type elevator system incorporates a control system for controlling power supply to each elevator car which has a configuration shown in FIG. 4.

In this control system shown in FIG. 4, the primary coil 31 provided on each travelling corridors A to Z is divided into a plurality of sections a to y, and a control device 82 for controlling power supply is provided in correspondence to each i-th elevator car, where each section of the primary coil 31 is equipped with a plurality of section selection switches 83 provided in a number corresponding to a number of elevator cars which are for selectively supplying the current supplied from one of the control devices 82 to the primary coil 31.

Here, the division of the primary coil 31 of each travelling corridor into a plurality of sections a to y is adopted because otherwise the primary coil 31 would have to be quite lengthy and such a lengthy coil has a large power loss so that a use of the lengthy coil for the primary coil 31 is undesirable economically.

Thus, in a case the k-th elevator car is to run through the j-th section of the ith travelling corridor, the kij-th section selection switch 83 is activated by the from the k-th control device 82 to the j-th section of the primary coil 31 for the i-th travelling corridor in order to drive the k-th elevator car through the j-th section of the i-th travelling corridor. In other words, when the 1st elevator car is located at the a-th section of the travelling corridor A for example, the control device 82 for the 1st elevator car activates the 1Aa-th section selection switch 83 to drive the 1st elevator car through the a-th section, and then as the 1st elevator car moves to the next b-th section, the control device 82 for the 1st elevator car switches the activated section selection switch 83 from the 1Aa-th one to the 1Ab-th one, and so on.

Here, the control devices 82 are located in a control chamber separated from the travelling corridors while the section selection switches 83 are located in a vicinity of the primary coil 31 in the travelling corridor. This arrangement is adopted because if the section selection switches 83 were also to be located in the control chamber, an enormous number of main circuit current supply lines must be provided between the section selection switches 83 in the control chamber and each section of the primary coil 31.

In this regard, by locating the section selection switches 83 in a vicinity of the primary coil 31, it suffices to provide a single section selection switch input line from the control device 82 between the top floor and the bottom floor and to make branchings from such a section selection switch input line to each section selection switches 83, so that a number of main circuit current supply lines required can be reduced considerably. Furthermore, by making the branchings from one section selection switch input line in one travelling corridor to the other travelling corridors, a number of main circuit current supply lines required can be further reduced to be as many as a number of elevator cars.

Figure 5:
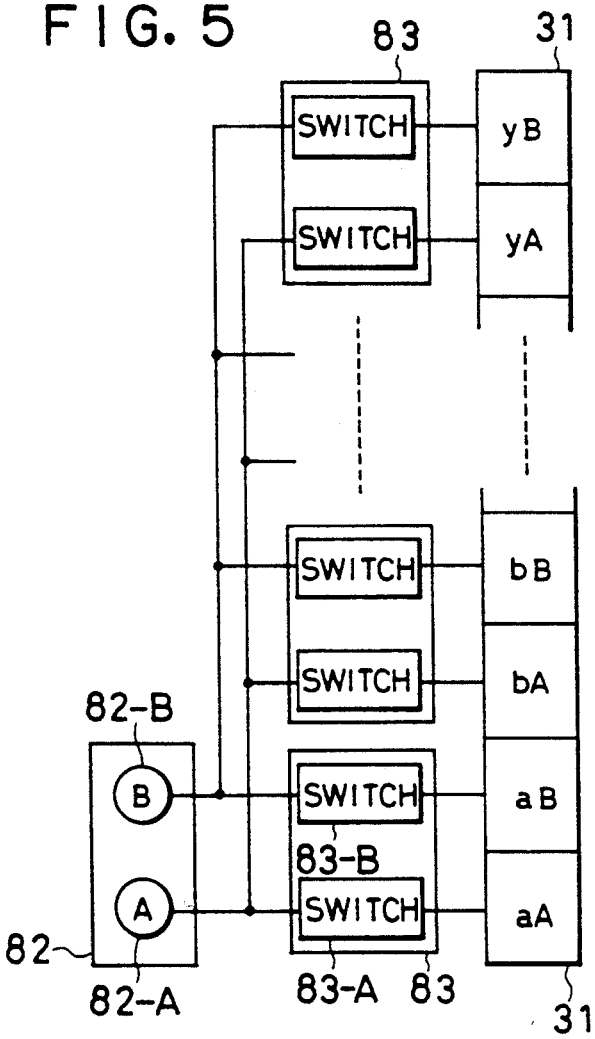
FIG. 5 is a diagram of one possible configuration of a control device and section selection switches in the control system of FIG. 4.

Referring now to FIG. 5, a further detail configuration of the control device 82 and the section selection switch 83 will be described.

As shown in FIG. 5, each section a to y of the primary coil 31 in this embodiment is further divided into two sub-sections A and B, such that the primary coil 31 has the sub-sections arranged in an order of aA, aB, bA, bB,- - -, yA, yB. Correspondingly, each section selection switch 83 has an A-th sub-section selection switch 83-A and a B-th sub-section selection switch 83-B, while each control device 82 has an A-th sub-section power supply 82-A and a B-th sub-section power supply 82-B. Each A-th sub-section of the sections a to y is connected with one A-th sub-section selection switch 83-A while each B-th sub-section of the sections a to y is connected with one B-th sub-section selection switch 83-B. Each A-th sub-section power supply 82-A of each control device 82 is connected to all the A-th sub-section selection switches 83-A of the section selection switches 83, while each B-th sub-section power supply 82-B of each control device 82 is connected to all the B-th sub-section selection switches 83-B of the section selection switches 83.

Thus, when the elevator car is located at the A-th sub-section of the a-th section of the travelling corridor and to be moved toward the B-th sub-section of the a-th section, the control device 82 for this elevator car first activates the aA-th sub-section selection switch 83-A in order to drive the elevator car through the A-th sub-section, and then activates the aB-th sub-section selection switch 83-B shortly before the elevator car moves into the B-th sub-section. While the elevator car is located over both the A-th sub-section and the B-th sub-section, the control device 82 continues to activate both of the aA-th and aB-th sub-section selection switches 83-A and 83-B. When the elevator car moved into the B-th sub-section completely, the control device discontinue the activation of the aA-th sub-section selection switch 83-A while continuing the activation of the aB-th sub-section selection switch 83-B, and so on. In a case of moving the elevator car in an opposite direction, the operation described above is reversed.

Here, this control system adopts the policy of one elevator car per sub-section for each moment, so that the sub-section of this elevator system corresponds to the block section of the usual train system. When the length of each sub-section is too long, not only the loss of the linear motor is caused but also the proximity between the neighboring elevator car becomes severely restricted. For this reason, it is efficient to make the length of each sub-section to be longer than the length of each elevator car. On the other hand, when the length of each sub-section is too short, a number of section selection switches 83 would have to be increased considerably. Taking these considerations into account, as a preferable setting, the length of each sub-section should be selected to be approximately equal to the distance between the adjacent stopping floors such that one elevator car can stop at every stopping floor simultaneously.

The reason for sub-dividing each of the sections a to y of the primary coil 31 into two sub-sections as described above is that in a configuration in which the sections a to y are simply juxtaposed, the deterioration of the running performance of the elevator car can be caused as the load fluctuation generated by the change of the connection of the sections of the primary coil 31 at a time of switching operation by the section selection switch 83 functions as the large disturbance with respect to the linear motor driving power, and such a deterioration of the running performance of the elevator car is preferable.

Thus, by adopting the configuration of the control device 82 and the section selection switch 83 as shown in FIG. 5, the smooth running performance of the elevator car can be secured, without an increasing the power loss which would result by using the excessively length primary coil 31.

Figure 6:
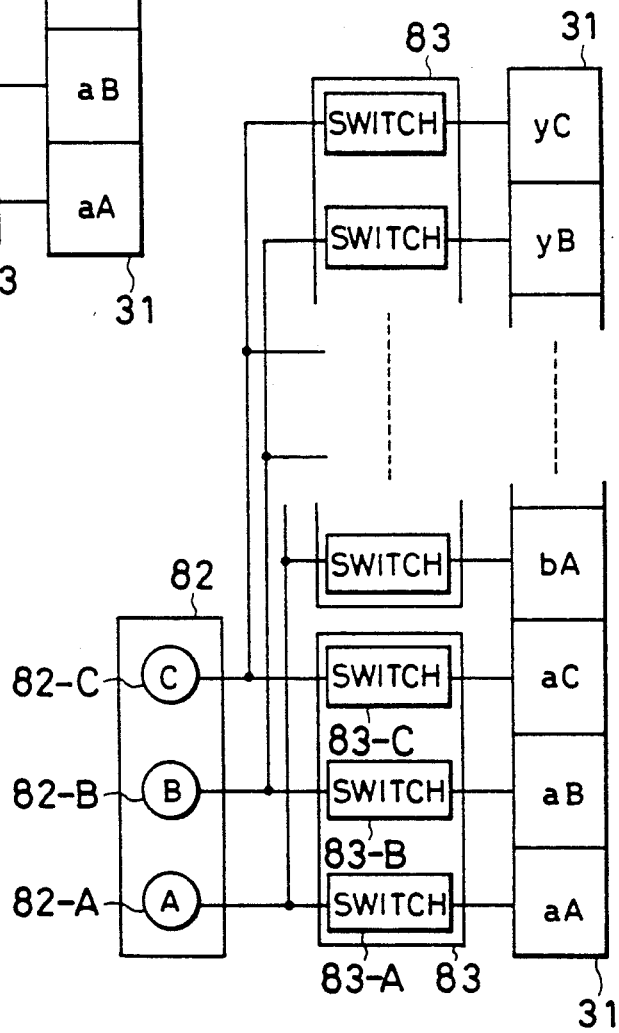
FIG. 6 is a diagram of another possible configuration of a control device and section selection switches in the control system of FIG. 4.
Figure 7:
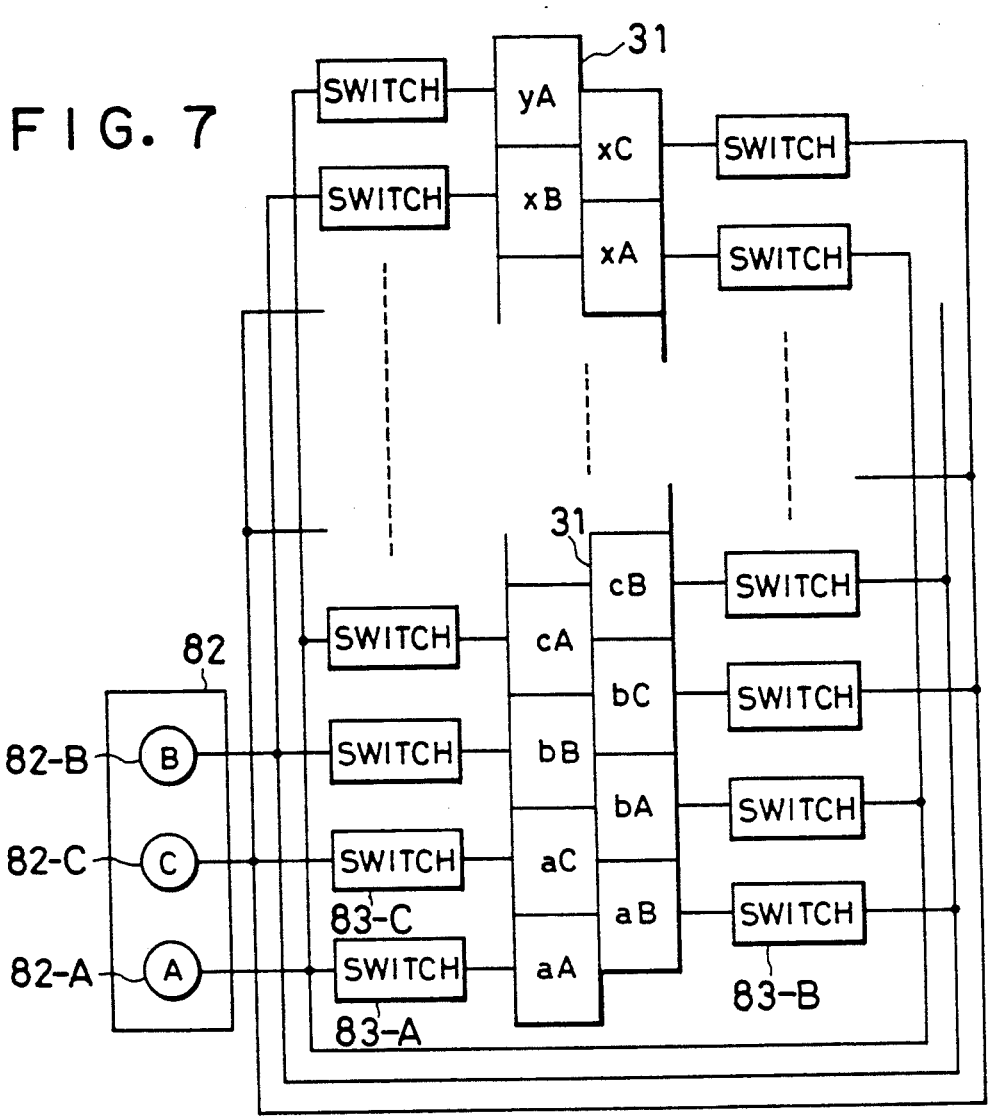
FIG. 7 is a diagram of still another possible configuration of a control device and section selection switches in the control system of FIG. 4.

Alternatively, the control system may adopt the configuration shown in FIG. 6 or FIG. 7.

In a case of a configuration shown in FIG. 6, each of the sections a to y of the primary coil 31 is further divided into three sub-sections A, B, and C rather than just two sub-sections in the configuration of FIG. 5, while in a case of a configuration shown in FIG. 7, the primary coil 31 has double coil layers, where each of the double coil layers is sub-divided into sub-sections such that each of the sections a to y is formed from three partially overlapping adjacent sub-sections A, B, and C on the double coil layers.

In either case, three adjacent sub-section selection switches are sequentially activated in an order such as aA+aB+aC→ aB+aC+bA→ aC+bA+bB→ bA+bB+bC→. . . , etc, in order to ensure the smooth running performance of the elevator car.

The configuration of FIG. 6 has an advantage that the spare time can be provided in the switching of the sub-sections as a result of the presence of the third sub-section, so that it is effective for a high speed elevator car. The configuration of FIG. 7 has an advantage that the linear motor driving force to be exerted by each of the double coil layers can be reduced by one half, and consequently the external disturbance on the elevator car due to the driving force difference between the linear motor driving forces from the double coil layers can be reduced by one half, such that the quality of the running performance by the elevator car can be further improved.

Figure 8:
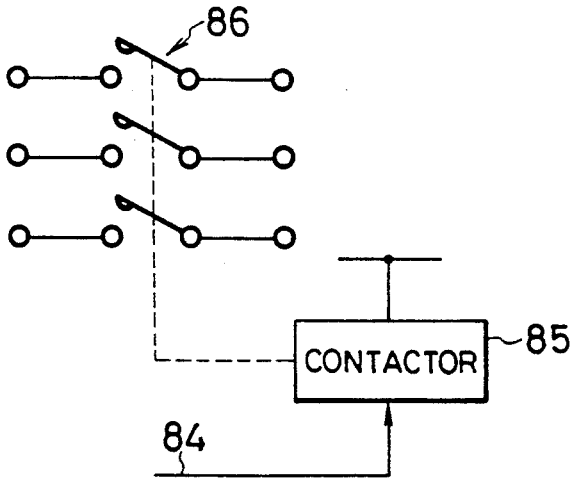
FIG. 8 is a schematic diagram of one possible detail configuration of a section selection switch in the control system of FIG. 4.
Figure 9:
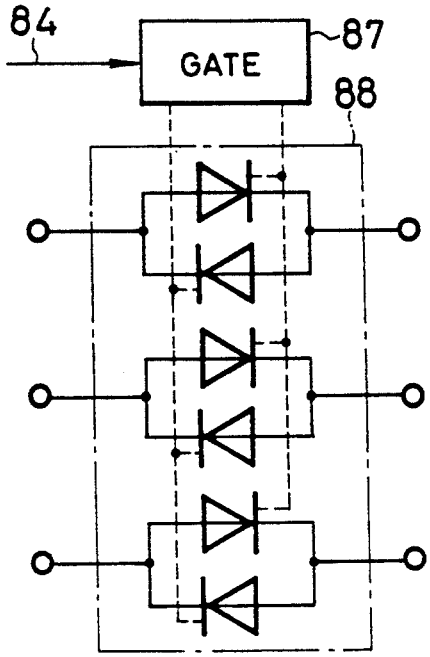
FIG. 9 is a schematic diagram of another possible detail configuration of a section selection switch in the control system of FIG. 4.

Referring now to FIGS. 8 and 9, a detail configuration of each sub-section selection switch will be described in detail.

In this embodiment, a multiple phase alternating current such as a three phase alternating current is used in order to obtain a large driving power from the linear motors. For this reason, the sub-section selection switch needs to be capable of transmitting or disrupting the three phase alternating current.

One exemplary configuration for such a sub-section selection switch is shown in FIG. 8, where an opening or closing of switches 86 is controlled by an electric contactor 85 in accordance with a selection command signal 84 transmitted from the control device 82, such that the supply of the power can be controlled as the control device 82 controls the action of the switches 86 through the electric contactor 85 by using the selection command signal 84.

Another exemplary configuration for such a sub-section selection switch is shown in FIG. 9, where an opening or closing of semiconductor switches 88 formed from natural commutator elements such as thyristors connected in three phase reversed parallel configuration is controlled by a gate circuit 87 which in turn is controlled by the selection command signal 84 transmitted from the control device 82, such that the supply of the power can be controlled as the control device 82 controls the action of the semiconductor switches 88 through the gate circuit 87 by using the selection command signal 84. Here, because the natural commutator elements are used for the semiconductor switches 88, the semiconductor switches 88 will be put into an OFF state whenever an inverse alternating voltage is applied in order to turn off the natural commutator elements. Also, one phase of the three phases may be maintained in an ON state all the time without affecting the result of the above described switching operation, so that the natural commutator element for one of the semiconductor switches 88 may be omitted.

This sub-section selection switch of FIG. 9 has an advantage over the sub-section selection switch of FIG. 8 in that the electric contactor 85 of the sub-section selection switch of FIG. 8 may cause a noise problem when the sub-section selection switches are placed inside the travelling corridors, whereas the sub-section selection switch of FIG. 9 is free from such a noise problem.

Figure 10:
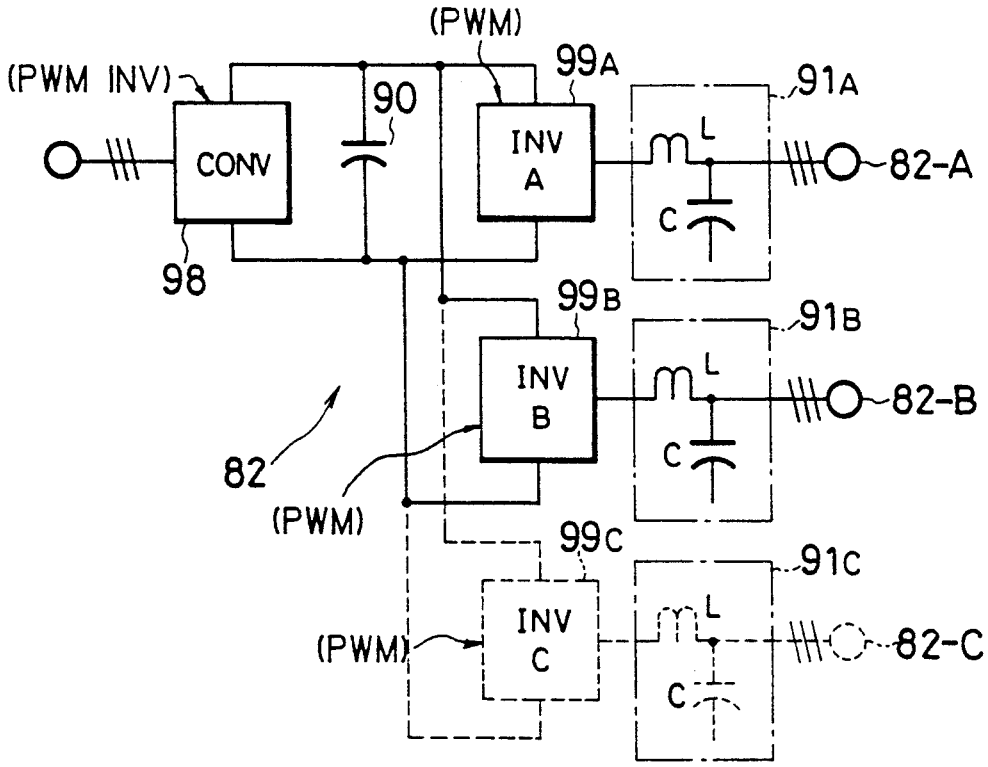
FIG. 10 is a schematic diagram of a detail configuration of a control device in the control system of FIG. 4.

Referring now to FIG. 10, a detail configuration of each control device 82 will be described in detail.

For the linear motors to be used in this elevator system, the linear motors of LSM (linear synchronous motor) type is suitable, but the linear motors of LIM (linear induction motor) type may also be used by using the superconducting windings for the primary coil 31 in which case the secondary conductor on each elevator car can have a simplified configuration using an induction plate instead of a permanent magnet.

In either case, the control device needs to be capable of carrying out the speed control of the elevator car by appropriately supplying the driving power of variable voltage and variable frequency to the primary coil 31 formed from three phase windings. For this reason, the control device 82 in this embodiment has a configuration shown in FIG. 10.

The control device 82 of FIG. 10 comprises: a converter (CONV) 98 for converting the AC power available at the building in which the elevator system is installed into the DC power; two or three inverters (INV A, B, and C) 99A, 99B, and 99C for supplying driving power to the A-th and B-th sub-sections in the configuration of FIG. 6 or to the A-th, B-th, and C-th sub-sections in the configurations of FIGS. 7 and 8; a smoothing capacitor 40 for a DC circuitry; and filter circuits 91A, 91B, and 91C for wave shaping provided at output sides of the inverters 99A, 99B, and 99C, respectively.

Each of the inverters 99A, 99B, and 99C is formed from a sine wave PWM (pulse width modulation) inverter using a large power transistor or GTO (gate turn-off). Here, the voltage type inverters are used because it is easy for the voltage type inverters to be provided in plurality and controlled with respect to the same DC power source quite independently from the converter.

However, the current type inverters may be used in which case the inverters 99A, 99B, and 99C should be formed to be independent from each other. Moreover, the other types of variable voltage, variable frequency control circuits may be used for the inverters 99A, 99B, and 99C.

The converter 98 may also be formed from the similar PWM inverter circuit configuration in which case the regenerative driving energy of the linear motors can be returned to the AC power source and the improvement can be achieved in the source power factor and the higher harmonics.

Each of the filter circuits 91A, 91B, and 91C is preferably be a resonant filter formed from a reactor L and a capacitor C as shown in FIG. 10. These filter circuits 91A, 91B, and 91C are particularly effective when the sub-section selection switch of FIG. 9 using the semiconductor switches formed by the natural commutator type thyristors is adopted. This is because the driving power supply control by the ON and OFF control of the natural commutator type thyristors is theoretically impossible when the output voltages are given in comb-like shapes obtained by the PWM control, and the filters to change the output voltages into the approximate sine wave forms become necessary. In this case, the magnetic noise can also be reduced considerably by the use of the PWM control.

In the control device 82 having such a configuration, the DC power provided from the converter 98 can be controlled in basically the identical mode by each of the inverters 99A, 99B, and 99C.

When such a control device 82 using a converter and inverters is used, a plurality of outputs must be provided because the single output alone could cause the deterioration of the running performance of the elevator car as the load fluctuation generated by the change of the connection of the sections of the primary coil 31 at a time of switching operation by the section selection switch 83 functions as the large disturbance with respect to the linear motor driving power. As a consequence, each section of the primary coil 31 have to be divided into sub-sections as already described with references to FIGS. 5, 6, and 7 above.

As described, according to the self running type elevator system using linear motors of this embodiment, a control of power supply to a plurality of elevator cars can be achieved without increasing the size of the system enormously, even when a number of the travelling corridors increases and a length of each travelling corridor becomes longer, because the control devices are provided in correspondence to the elevator cars so that the number of control devices need not be increased in such cases. Moreover, the section selection switches can be provided in a vicinity of the travelling corridors, so that a number of main circuit current supply lines for transmitting the driving power supply can be reduced considerably, so that the enormous increase of the size of the system as well as the higher cost for the system can be prevented.

It is to be noted that besides those already mentioned above, many modifications and variations of the above embodiment may be made without departing from the novel and advantageous features of the present invention. Accordingly, all such modifications and variations are intended to be included within the scope of the appended claims.

What is claimed is:

1. A self running type elevator system, comprising:

at least one travelling corridor, each of which is equipped with a primary coil of a linear motor;

a plurality of elevator cars placed inside said at least one travelling corridor, each of which is equipped with a secondary conductor of the linear motor; and a plurality of control device means, provided in correspondence to the elevator cars, each of said control device means for controlling a supply of a driving power to the primary coil at a position of the corresponding elevator car such that the corresponding elevator car is driven by a driving force produced between the primary coil and the secondary conductor of the linear motor by the driving power.

2. The elevator system of claim 1, wherein the primary coil of each travelling corridor is divided into sections, and the elevator system further comprises:

respective section selection switch means, provided for each of the sections of the primary coil in correspondence to the elevator cars, for selectively transmitting the driving power from a respective one of the control device means to a respective section of the primary coil at which a respective one of the elevator cars is located, under a control by the respective control device means.

3. The elevator system of claim 2, wherein each of the control device means comprises:

converter means for converting AC power available at a building in which the elevator system is installed into DC power;

a plurality of inverter means for supplying the DC power obtained by the converter means as the driving power to the respective section of the primary coil.

4. The elevator system of claim 3, wherein each of the control device means further comprises filter means for wave shaping provided at output sides of the inverter means.

5. The elevator system of claim 4, wherein the filter means of each of the control device means comprises a resonant type filter formed from a reactor and a capacitor.

6. The elevator system of claim 3, wherein each of the inverter means comprises a sine wave PWM inverter.

7. The elevator system of claim 3, wherein the converter means of each of said control device means comprises a sine wave PWM inverter.

8. The elevator system of claim 3, wherein each of the control device means further comprises a smoothing capacitor connected in parallel to the inverter means.

9. The elevator system of claim 2, wherein each of the section selection switch means comprises:

switch means for selectively transmitting the driving power from the respective control device means to the respective section of the primary coil at which the respective elevator car is located whenever the switch means is closed; and electric contactor means for controlling an opening and a closing of the switch means under a control by the respective control device means.

10. The elevator system of claim 2, wherein each of the section selection switch means comprises:

semiconductor switch means for selectively transmitting the driving power from the respective control device means to the respective section of the primary coil at which the respective elevator car is located whenever the switch means is closed; and gate circuit means for controlling an opening and a closing of the switch means under a control by the respective control device means.

11. The elevator system of claim 10, wherein each of the semiconductor switch means is formed from natural commutator elements.

12. The elevator system of claim 11, wherein each of the natural commutator elements are thyristors connected in reversed parallel configuration.

13. The elevator system of claim 2, wherein each of the control device means is located in a control chamber separated from said at least one travelling corridor, and each of the section selection switch means is located in a vicinity of the primary coil.

14. The elevator system of claim 13, further comprising main circuit current supply line means for transmitting the driving power supply from the respective control device means to the respective section selection switch means.

15. The elevator system of claim 14, wherein the main circuit current supply line means are provided in correspondence to said at least one travelling corridor, and each section selection switch means is connected with the main circuit current supply line of the respective travelling corridor through a branching.

16. The elevator system of claim 14, wherein the main circuit current supply means are provide for only as many as a number of the elevator cars, and are branched into branchings for each of said at least one travelling corridor.

17. The elevator system of claim 2, wherein each section of the primary coil is further divided into a plurality of sub-sections, and wherein each of the section selection means comprises a plurality of sub-section selection switch means, provided for each of the sub-sections in correspondence to the elevator cars, for selectively transmitting the driving power from the respective control device means to the respective sub-section at which the respective elevator car is located, under a control by the respective control device means.

18. The elevator system of claim 17, wherein each section of the primary coil is divided into at least three sub-sections.

19. The elevator system of claim 17, wherein the primary coil has a structure of double coil layers, and wherein each section of the primary coils is formed from three partially overlapping adjacent sub-sections on the double coil layers.

20. A method of controlling a self running type elevator system comprising at least one travelling corridor, each of which is equipped with a primary coil of linear motor, and a plurality of elevator cars placed inside said at least one travelling corridor, each of which is equipped with a secondary conductor of the linear motor, the method of comprising the steps of:

providing a plurality of control device means in correspondence to the elevator cars, for controlling power supply to the primary coil; and controlling the power supply to the primary coil by the control device mean such that a driving power is supplied to the primary coil at a position of one of the elevator cars in order to drive the elevator car by a driving force produced between the primary coil and the secondary conductor of the linear motor by the power supply.

* * * * *